US006368375B1

(12) United States Patent
Benz et al.

(10) Patent No.: US 6,368,375 B1
(45) Date of Patent: Apr. 9, 2002

(54) PROCESSING OF ELECTROSLAG REFINED METAL

(75) Inventors: Mark Gilbert Benz, Burnt Hills; William Thomas Carter, Jr., Galway; Bruce Alan Knudsen, Amsterdam; Robert John Zabala, Schenectady; Paul Leonard Dupree, Scotia, all of NY (US); Boris Izrailevich Medovar; Lev Borisovich Medovar, both of Kiev-5 (UA)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/194,789

(22) PCT Filed: Jun. 24, 1997

(86) PCT No.: PCT/US97/10902

§ 371 Date: Oct. 25, 1999

§ 102(e) Date: Oct. 25, 1999

(87) PCT Pub. No.: WO97/49837

PCT Pub. Date: Dec. 31, 1997

Related U.S. Application Data

(60) Provisional application No. 60/020,300, filed on Jun. 24, 1996.

(51) Int. Cl.[7] ..... C22B 9/18; C22B 4/06

(52) U.S. Cl. ..... 75/10.25; 75/345; 75/347; 420/590

(58) Field of Search ..... 420/590; 75/345, 75/347, 10.25

(56) References Cited

U.S. PATENT DOCUMENTS

| | | | |
|---|---|---|---|
| 4,185,682 A | 1/1980 | Ksendzyk et al. | |
| 4,305,451 A | 12/1981 | Ksendzyk et al. | |
| 4,966,222 A | 10/1990 | Paton et al. | |
| 5,160,532 A | 11/1992 | Benz et al. | |
| 5,310,165 A | 5/1994 | Benz et al. | |
| 5,325,906 A | 7/1994 | Benz et al. | |
| 5,332,197 A | 7/1994 | Benz et al. | |
| 5,348,566 A | 9/1994 | Sawyer et al. | |
| 5,366,206 A | 11/1994 | Sawyer et al. | |

FOREIGN PATENT DOCUMENTS

| | | | | |
|---|---|---|---|---|
| GB | 2265806 A | | 6/1993 | |
| JP | 06100953 | * | 4/1994 | ..... 75/10.26 |

OTHER PUBLICATIONS

Derwent Machine–Assisted Translation of JP 100953 Apr. 12, 1994.*

"Electroslag Processes Without Consumable Electrodes", by B. L. Medovar et al., *Proceedings of the 1997 International Symposium on Liquid Metal Processing and Casting*, Santa Fe, New Mexico, Feb. 16, 1997.

* cited by examiner

*Primary Examiner*—Roy King
*Assistant Examiner*—Tima McGuthry-Banks
(74) *Attorney, Agent, or Firm*—Noreen C. Johnson; Christian G. Cabou

(57) ABSTRACT

In a method and apparatus for the electroslag refining of metal, the method includes providing a refining vessel to contain an electroslag refining layer floating on a layer of molten refined metal. The refining vessel representing an upper part of a cooled mould comprises a plurality of superimposed sleeves which are electrically insulated from one another. The top sleeve, being the refining vessel, is substantially a non-consumable electrode and has a current lead electrically insulated from the sleeve. The molten electroslag layer is heated by a refining current which is passed from a power source through the mould and slag layer to the metal pool. An unrefined metal is lowered into the vessel into contact with the molten electroslag layer such that its surface is melted and overheated at the point of contact with the slag such that droplets of the metal are formed and these droplets pass down through the slag and are collected in a pool of molten refined metal beneath the slag.

35 Claims, 3 Drawing Sheets

PROCESSING OF ELECTROSLAG REFINED METAL

This application claims priority of provisional application, Serial No. 60/020,300, filed Jun. 24, 1996 and PCT application No. PCT/US97/10902, filed Jun. 24, 1997.

FIELD OF THE INVENTION

The present invention relates generally to direct processing of metal passing through an electroslag refining operation. More specifically, it relates to an apparatus and method having a split, insulated crucible that provides current through a non-consumable electrode with at least one pair of symmetrical electrical leads in the electroslag processing apparatus. The invention further relates to atomizing, or otherwise directly processing a stream of refined metal, which stream is generated directly beneath an electroslag processing apparatus.

BACKGROUND OF THE INVENTION

It is known that the processing and refining of relatively large bodies of metal, such as superalloys, are accompanied by many problems due to the bulky volume of the body of metal itself. One such problem is controlling the grain size and other microstructure of the refined metals. Because the volume of the metal being refined is generally in the order of about 5,000 to about 35,000 pounds or more, the refining processing involves multiple steps, such as sequential heating and melting, forming, cooling, and reheating of the large bodies of metal. Further, as processing by melting and similar operations is carried out on large bodies of metal, problems of segregation of the alloy elements or ingredients of the metal also occur. Often, a lengthy and expensive sequence of processing operations is selected in order to overcome the above-mentioned difficulties which arise through the use of bulk processing and refining operations of metals.

One such sequence of steps used in industry, involves vacuum induction melting; followed by electroslag refining; followed, in turn, by vacuum arc refining and followed, again in turn, by mechanical working through forging and drawing. While the metal produced by such a sequence is highly useful and the metal product itself is quite valuable, the processing sequence is quite expensive and time-consuming.

For example, vacuum induction melting of scrap metal into a large body of metal, such as between 20,000 to about 35,000 pounds or more, can be very useful for the recovery of the scrap material. The scrap and other metal is processed through the vacuum induction melting steps to form a large ingot. Such a formed ingot has considerably more value than the scrap and other material used to form the ingot. However, in accordance with the conventional vacuum induction melting process, the large ingot product is usually found to contain one or more of three types of defects: specially voids, slag inclusions, and macrosegregation.

The recovery of scrap metal into an ingot is usually the first step in an expensive, time-consuming metal refining process. Some of subsequent processing steps are specifically to cure the defects generated during prior metal processing steps. For instance, after the scrap metal is formed into a large ingot, it then is often processed through an electroslag refining step to remove oxides and sulfides. The product of the electroslag refining process containes lower concentrations of these impurities.

However, problems also occur during the conventional electroslag refining process. Briefly, the conventional electroslag process includes a refining vessel containing a slag refining layer floating on a layer of molten refined metal. An ingot of unrefined metal is used as a consumable electrode and is lowered into the vessel to make contact with the molten electroslag layer. A refining current is passed through the slag layer to the ingot and causes surface melting at the interface between the ingot and the slag layer. As the ingot is melted, oxide inclusions or impurities are exposed to the slag and removed from the metal at the point of contact between the ingot and the slag. Droplets of refined metal are formed and these droplets pass down through the slag to be collected in a pool of molten refined metal beneath the slag.

The apparatus mentioned above, having an ingot as a consumable electrode, includes a fixed relationship between the individual parameters of the process and, in particular, between the intensity of the refined current, the specific heat input, and the melting rate. This fixed relationship entails undesirable interdependence between the rate of electroslag refining of the metal, the metal ingot temperature and the rate at which the refined molten metal is cooled. In addition, there are problems concerning preparation of a large consumable electrode ingot. Further, in the past, it has been difficult for a conventional electroslag process utilizing a consumable electrode to provide active stirring of the metal and the slag. Thus, it would be desirable to provide an apparatus that does not need to use a consumable electrode ingot. It is also desirable to provide an apparatus that increases the active stirring of the metal and the slag to essentially improve the refining effect of the electroslag process.

Another problem of conventional electroslag refining is the formation of a relatively deep metal pool in the electroslag crucible. This deep melt pool causes a varied degree of ingredient macrosegregation which leads to a less desirable microstructure in the end product. To overcome this deep melt pool problem, a subsequent processing operation is employed in combination with the electroslag refining process. This latter processing may typically be vacuum arc refining. Vacuum arc refining is initiated when the ingot produced by electroslag refining is processed through the vacuum arc steps to produce a relatively shallow melt pool whereby an improved microstructure, perhaps also having a lower hydrogen content, is produced. Following the vacuum arc refining process, the resulting ingot is then mechanically worked to yield a metal stock having a better microstructure. Such mechanical working may involve a combination of steps of forging and drawing. This thermo-mechanical processing requires large, expensive equipment, as well as costly amounts of energy input.

As pointed out, the drawbacks to using the above-recited combination of process steps are many. Thus there is a need for a simplified, less costly, and time efficient method and apparatus for processing metals.

A method and apparatus which permit formation of relatively large ingots of metal of uniform composition and desirably fine microstructure without the need for extensive processing has been previously suggested by the General Electric Company in a number of patents (U.S. Pat. Nos. 5,160,532; 5,310,165; 5,325,906; 5,332,197; 5,348,566 and 5,366,206).

The methods described in these patents involve a refining vessel containing an electroslag refining layer floating on a layer of molten refined metal with a consumable electrode ingot of unrefined metal. The droplets of the refined metal that are formed pass through the slag and are collected in a pool of molten refined metal beneath the slag. This refined metal is held in a cold hearth. At the bottom of the cold hearth, a cold finger orifice permits the withdrawal of refined metal from the cold hearth apparatus. The refined metal passes as a stream from the cold finger orifice and is processed into a metal structure having desirable grain structure. A .preferred method for forming such a structure is by spray forming.

The above process described in the GE patents has the capability of operating continuously for an extended period of time and, accordingly, processing a large bulk of metal, if the rate of electroslag refining of metal and accordingly, the rate of delivery of the refined metal to the cold hearth approximate the rate at which molten metal is drained from the cold hearth through the cold finger orifice.

The apparatus utilized above, having an ingot as a consumable electrode, included a fixed relationship between individual parameters of the process and, in particular, between the intensity of the refined current, specific heat input and the melting rate. This fixed relationship entails undesirable interdependence between the rate of electroslag refining of the metal, the metal temperature and the rate at which the molten metal is drained from the cold hearth through the cold finger orifice. In addition, there are some problems concerning preparation of a large consumable electrode metal ingot.

For all of the above-mentioned reasons, there is a need for a new and improved electroslag refining apparatus and method to produce high quality, refined metal articles.

SUMMARY OF THE INVENTION

This need is satisfied by providing in the present invention a method for refining metal comprising the steps of: providing metal with nonspecification chemistry and microstructure; introducing the metal into an electroslag refining vessel containing molten slag in a top sleeve of the vessel, said top sleeve of the vessel being a non-consumable electrode with at least one pair of symmetrical leads; contacting the molten slag in the vessel with the metal; passing a sufficient amount of electric current through the slag for causing the metal to melt or overheat at surfaces where the metal contacts the slag; removing inclusions or impurities from the metal exposed to the slag; passing droplets of the metal formed from such melting or overheating through the slag; collecting the descending molten metal in a hearth positioned beneath the electroslag refining vessel. The inventive method further comprises the step of: rotating or stirring the slag with the metal in the top sleeve of the refining vessel with an electromagnetic force. The electric current being passed through the slag with at least one pair of symmetrical leads passes through a circuit comprising a power supply, the molten slag, and said refining vessel to cause resistance heating of the slag. The circuit can also include the liquid refined metal. The electroslag composition is a salt containing calcium fluoride. In yet another aspect of the invention, the method further comprises the step of: providing a cold finger bottom pour spout at a bottom of the hearth for permitting the liquid metal to pass through the spout as a metal stream. The rate at which molten metal is drained from the hearth is about equivalent to the rate at which metal is melted. Still yet, the invention comprises the step of: forming the metal stream into an article having specification chemistry and microstructure. The article can have a preform shape, be atomized into powder, cast into a rod, spun into ribbon, or used as a filler metal for cladding or surfacing.

The present invention in another of its broader aspects may be accomplished by an apparatus for producing refined metal comprising a metal refining vessel adapted to hold a metal refining molten slag, means for supplying refining current to the molten slag, means for introducing filler metal into the vessel in touching contact with the molten slag, electric supply means for supplying refining current to the top sleeve of the vessel as a non-consumable electrode and through the molten slag and the metal pool to the current lead in the bottom sleeve of the vessel and for keeping the refining slag molten, a hearth beneath the metal refining vessel, the hearth receiving and holding electroslag refined molten metal in contact with a solid skull of the refined metal in contact with the hearth, a middle sleeve, operatively positioned between the metal refining vessel and the hearth, electrically insulated therefrom and including a control level mechanism. The top sleeve of the vessel further may comprise a means for rotating the molten slag together with the molten metal. The hearth may have a cold finger orifice, operatively positioned below the hearth for receiving and dispensing as a stream, molten metal processed through the electroslag refining process and through the hearth.

Still another aspect of the invention the formation of relatively large metal ingots having a uniform composition and a desirable fine microstructure without utilizing the extensive multistep process of the prior art.

Another aspect of the present invention provides a molten stream of above specification metal from below specification metal from forms including ingots, bars, tubes, plates, rods, etc., and also including loose materials (powder, granules, shavings, pieces of irregularly shaped metal) and liquid metal.

A further aspect of the present invention provides an apparatus and methods for overcoming interdependence between the rate of electroslag refining metal, metal temperature and the rate at which molten metal is drained from the cold hearth through the cold finger orifice.

Still another aspect of the present invention is to provide apparatus and methods for actively stirring the metal and the slag.

Other advantages of the present invention will be apparent from the following description and the accompanying drawings.

DETAILED DESCRIPTION OF THE INVENTION

One method of the present invention is carried out by introducing filler metal material to be refined, in the form of compact and loose material, and even liquid material, directly into an electroslag refining apparatus and effectively refining the metal by way of active stirring and/or rotating of the melted metal and the slag. The melt of refined metals produced thereby is received and retained within a hearth apparatus mounted below the electroslag refining apparatus.

The hearth is has cooled walls and is herein referred to as a cold hearth. In another aspect of the invention, the molten metal can then be dispensed from the cold hearth through a cold finger orifice mounted directly below the cold hearth reservoir. The metal can also remain in the hearth to solidify as a solid article.

Once the metal is drained from the cold hearth through the cold finger orifice, it may be further processed to produce a relatively large ingot of refined metal or it may be processed through alternative process steps to produce smaller articles or continuous cast articles such as strip or rod or similar metallurgical products. Amorphous alloy products may be produced by processing a thin stream of melt exiting from the finger orifice through a melt spinning operation in which the stream is directed onto the outer rim of a spinning water cooled wheel. The metal stream can also be atomized to form a powder material. This method effectively eliminates many of the processing operations such as those described in the background statement above which have previously been necessary in order to produce an end metal product having desired properties.

A very important aspect of the present invention is that it is now possible to avoid undesirable interdependence between the rate of electroslag refining of metal, metal and slag temperature and the rate at which metal is drained from the cold hearth through the cold finger orifice during this process.

The process described herein is applicable to a wide range of alloys which can be beneficially processed through the electroslag refining process. Such alloys include, but are not limited to, nickel and cobalt-based superalloys, titanium-based alloys, and ferrous-based alloys, among others. The slag used in connection with such metals will vary with the metal being processed and will usually be the slag conventionally used with a particular metal in the conventional electroslag refining thereof.

Figure 1:
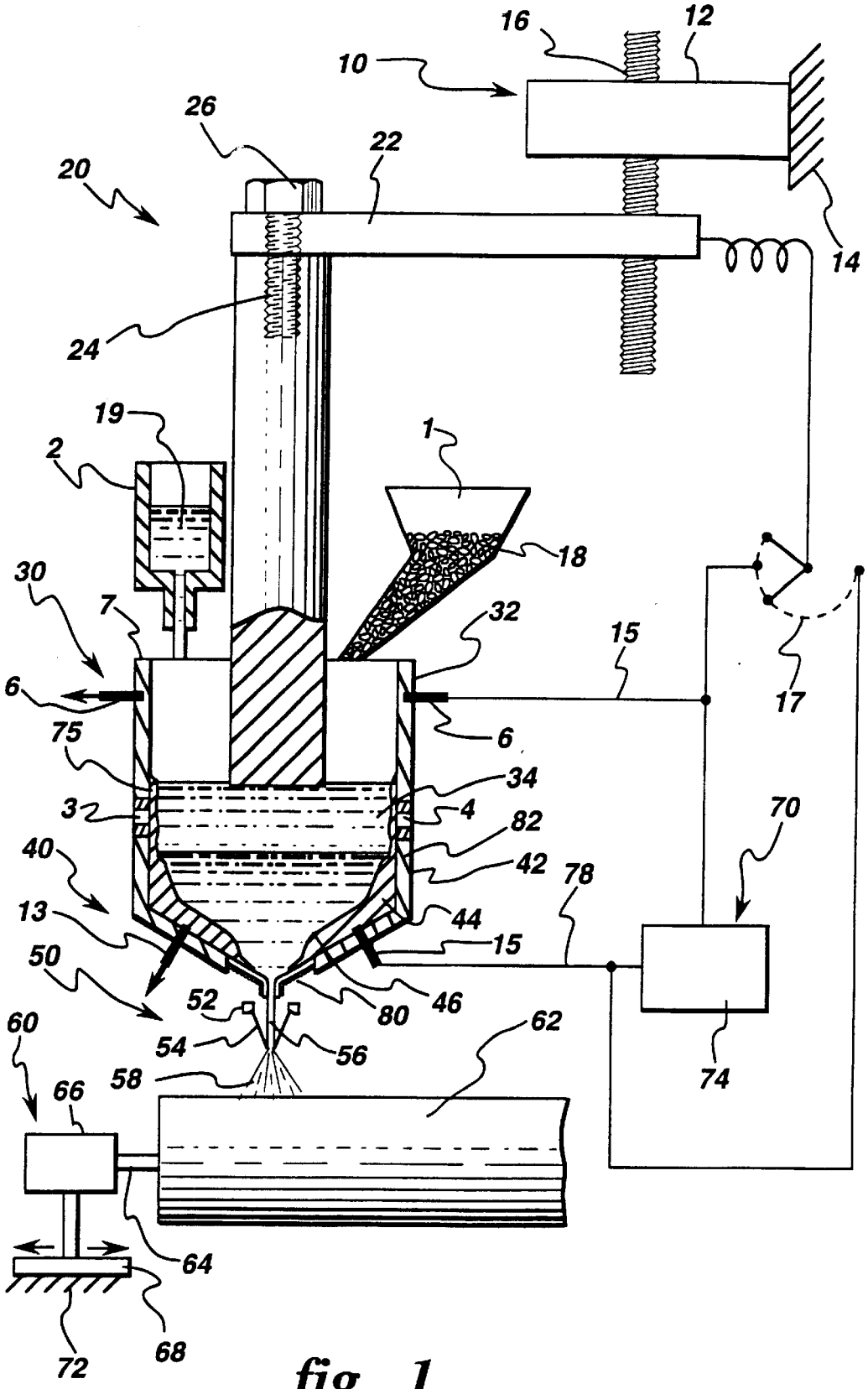
FIG. 1 is a detailed semi-schematic vertical sectional view of an apparatus suitable for carrying out the present invention.
Figure 2:
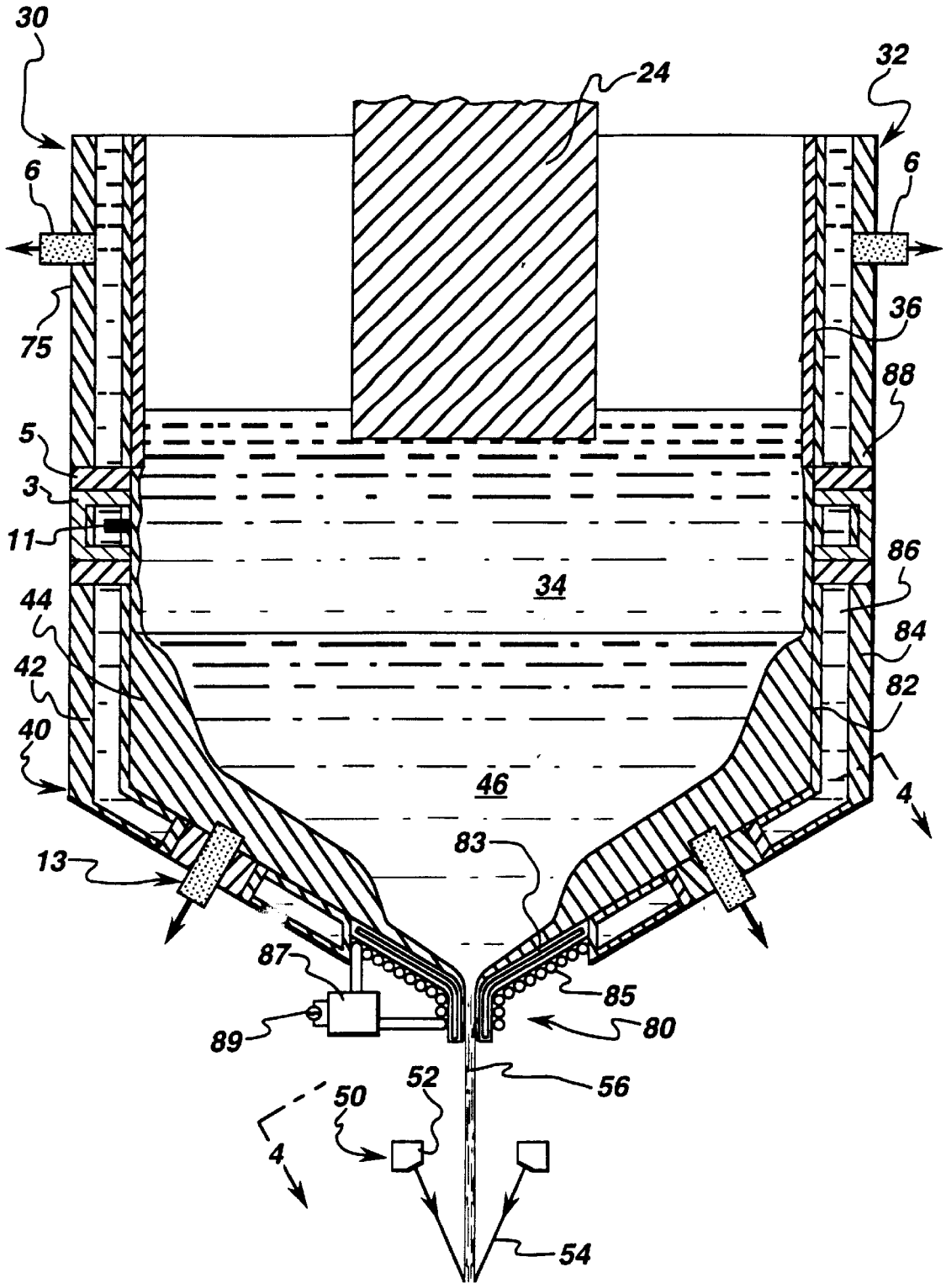
FIG. 2 is a semi-schematic vertical sectional illustration of the apparatus of FIG. 1.

Referring now particularly to the accompanying drawings, FIG. 1 is a semischematic elevational view of a number of the essential and auxiliary elements of a representative apparatus for carrying out the present invention. Referring now, first, to FIGS. 1 and 2, there are a number of process stations and mechanisms including a vertical motion control apparatus 10 shown schematically. The vertical motion control apparatus includes a box 12 mounted to a vertical support 14, the box contains a motor or other mechanism for imparting rotary motion to a screw member 16. A compact metal body support station 20 includes a bar 22 threadedly engaged at one end to the screw member 16 at the other end and means for supporting the compact filler metal 24, such as, for example, by conventional bolt means 26.

Conventional design filler feed mechanisms 1 and 2 for supplying loose 18 or/and liquid 19 materials accordingly is positioned above the crucible so as to feed metal into the slag bath.

An electroslag refining station 30 includes a water cooled vessel 32 forming an open-end cavity containing a molten slag 34 and having at least two leads 6 which connect the electroslag refining station to a power source, as described below.

For protection from spark erosion the station 30 has a lining 7 made of electrically conducting material. The lining is made of graphite. It is also possible to make the lining of a refractory metal, such as tungsten or molybdenum.

The mould construction, or top sleeve of the refining vessel, being a non-consumable electrode is not itself a novel structure but has been described in U.S. Pat. Nos. 4,185,682 and 4,305,451, the disclosures of each are herein incorporated by reference. In these patents, a description is given of the mould having a single lead connected to the top sleeve of the mould and to a power source. Such connection cannot be made symmetrical about magnetic bodies that are located into the electroslag power source outline which results in big energy losses in power lines.

We have now devised a different structure from that disclosed in the above-mentioned patents. The new structure has two or more symmetrical leads connected to the electroslag refining vessel and to a power source that results in a considerable decrease in power losses. Additionally, the new structure includes an inner surface of the refining vessel for making a surface check to close contact between the vessel and the lining of a refractory metal that results in uniform current density in the slag pool.

Figure 3:
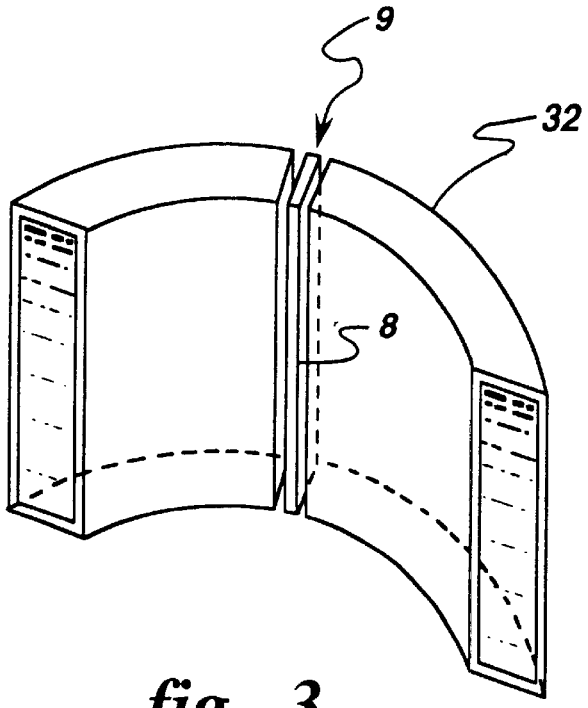
FIG. 3 is a fragmentary perspective view of a current supply electroslag refining vessel used to rotate the slag, and metal.

The wall of the current supply water cooled vessel 32 may be provided with at least one, and preferably at least two, radially oriented vertically extending open slots 8 filled with an electrically insulating material 9, e.g., asbestos or mica (FIG. 3). In this case, the vessel functions as a means for creating an electromagnetic field force which causes an unidirectional stable rotary motion or stirring of the molten slag.

A middle sleeve 3 is mounted immediately below the electroslag refining station and it is of a height substantially smaller than the height of the electroslag refining station 30 and the lower cold hearth station 40. It includes a water cooled vessel 4 and supplied with a control level mechanism 11 shown schematically. Between each pair of adjoining sleeves 30, 3 and 3, 40, insulating gaskets 5 made, for instance, of asbestos or mica are positioned. A skull of slag 75 may form along the inside surfaces of the inner wall 82 of the vessel 4 due to the cooling water flowing against the outside surface of inner wall 82.

A cold hearth station 40 is mounted immediately below the middle sleeve 3 and includes a water cooled hearth 42 containing a skull 44 of solidified refined metal and also a body 46 of liquid refined metal. Two current leads 13 electrically isolated from the hearth 42 (FIG. 4) are provided.

In one embodiment, the bottom opening structure 80 of the crucible is provided in the form of a cold finger orifice. An optional station 50 is provided immediately below the cold hearth station and the cold finger orifice. This optional station has a gas orifice and manifold 52 which generates streams of gas 54. These gas streams impact on a stream of liquid metal 56 exiting from the cold finger structure 80 to produce a spray 58 of molten metal. The cold finger structure 80 has been previously described in the US Patents incorporated by reference above.

As disclosed in the above-mentioned patents, the bottom opening structure 80 combines a cold hearth with a cold finger orifice so that the cold finger structure effectively forms the center lower part of the cold hearth. In this case, the cold hearth mechanism permits the purified alloy to form a skull by its contact with the cold hearth and thereby to serve as a container for the molten version of the same purified alloy. In addition, the cold finger orifice structure 80 provides a controllable skull 83 having a smaller thickness on the inside surface of the cold finger structure. As evident from FIG. 2, the thicker skull 44 in contact with the cold hearth and the thinner skull 83 in contact with the cold finger structure are essentially continuous.

One reason why the skull 83 is thinner than 44 is that a controlled amount of heat may be put into the skull 83 and into the liquid metal body 46 which is proximate the skull 83 by means of the induction heating coils 85. The induction heating coil 85 is cooled by a cooling water flowing through the coolant and power supply 87.

Induction heating power supplied to the coolant and power supply 87 from a power source 89 is shown schematically in FIG. 2. One significant advantage of the construction of the cold finger structure 80 is that the heating effect of the induction energy penetrates through the cold finger structure and acts on the body of liquid metal 46 as well as on the skull 83 to apply heat thereto. This is one feature of the cold finger structure and such feature depends on each of the fingers of the cold finger structure being insulated from the adjoining fingers by an air or gas gap or by an insulating material.

Because it is possible to control the amount of heating and cooling passing from the induction coils 85 to and through the cold finger structure 80, it is possible to adjust the amount of heating or cooling which is provided through the cold finger structure both to the skull 83 as well as to the body 46 of molten metal in contact with the skull.

The lowest station 60 is a spray collection station which includes a solid receiving surface such as ingot 62. The ingot 62 is supported by a bar 64 mounted for rotary movement by motor 66 which, in turn, is mounted to a reciprocating mechanism 68 on a structural support 72.

Figure 4:
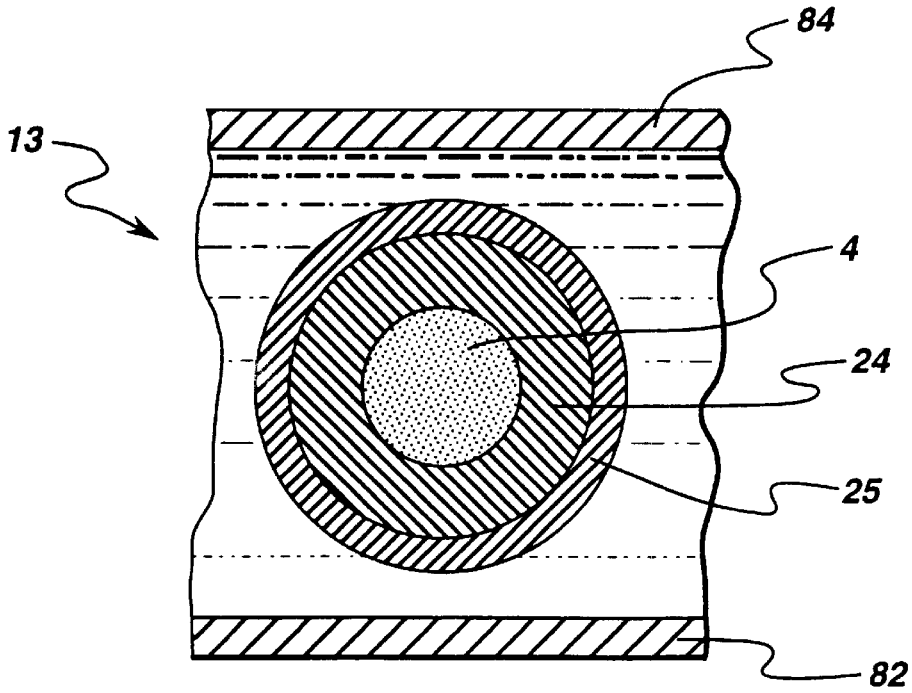
FIG. 4 is a semi-schematic illustration of the cold hearth apparatus of FIG. 2 showing current lead of the bottom sleeve of the vessel.

Electric refining current is supplied by station 70 which includes an electric power supply and control mechanism 74. Station 70 also includes a conductor 15 for carrying current to the electroslag refining vessel 30 through leads 6. Conductor 78 carries current to the cold hearth 40 through the leads 13 to complete the current circuit of the electroslag refining mechanism. The leads 13 are electrically isolated from the cold hearth to cause current to flow through the metal skull heating the skull but not the cold hearth wall (FIG. 4). Station 70 also includes a current reversing mechanism 17 for introducing compact metal body in the current circuit of necessity.

Referring now more specifically to FIG. 2, a more detailed view of stations 30, 40 and 50 of FIG. 1 is illustrated. In general, the reference numerals as used in FIG. 2 correspond to the reference numerals as used in FIG. 1 so that like parts bearing the same reference numeral have essentially the same construction and function as was described with reference to FIG. 1.

Similarly, the same reference numerals are used with respect to the same parts in the still more detailed views of FIGS. 3 and 4 discussed more thoroughly below.

As indicated above, FIG. 2 illustrates in greater detail the electroslag refining vessel, the middle vessel, the cold hearth vessel, and the various apparatus associated with these vessels. As shown, the vessels are double walled vessels having inner walls 36, 82 and outer walls 84, 88. Between these two walls a cooling liquid such as water 86 is provided as is conventional practice with some cold hearth apparatus. The cooling water 86 may be flowed to and through the flow channel between the inner wall 82 and outer wall 84 from supply means and through conventional inlet and other conventional means (not shown). The use of cooling water, such as 86, to provide cooling of the walls of the cold hearth station 40 is necessary in order to provide cooling at the inner wall 82 and thereby to cause the skull 44 to form on the inner surface of the cold hearth structure. The cooling water 86 is not essential to the operation of the electroslag refining or to the upper portion of the electroslag refining station 30 but such cooling may be provided to insure that the liquid metal 46 will not make contact with the inner wall 82 of the containment structure because the liquid metal 46 could attack the wall 82 and cause some dissolution therefrom to contaminate the liquid metal of body 46 within the cold hearth station 40.

In operation, the apparatus of the present invention may best be described with reference to FIG. 1. One feature of the present invention, illustratively shown in FIG. 1, concerns the throughput capacity of the apparatus. As is indicated, the compact unrefined metal body 24 together with loose 18 and/or liquid unrefined metal 19 may be processed in a single pass through the electroslag refining and related apparatus and through the atomization station 50 to form a relatively large volume ingot 62 through the spray forming process. Very substantial volumes of metal can be processed through the apparatus because the starting metals have relatively small concentrations of impurities such as oxides, sulfides, and the like, which are removed by the electroslag refining process. The ingot 62 formed by the process, as illustrated in FIG. 1, is a refined ingot and is substantially free of the oxides, sulfides, and other impurities which are removed by the electroslag refining of station 30 of the apparatus of FIG. 1.

While the process, as illustrated in FIG. 1, deals with the spray forming of the ingot 62, it will be realized that the atomization station 50 may be employed simply to produce atomized metal. In this case, no ingot 62 is formed but rather the product of the process is the formation of powder which may be employed in conventional powder metallurgy processing to form finished articles through well-known established practice.

An alternative use of the apparatus, as illustrated in FIG. 1, is a melt spinning operation. Such melt spinning would omit the atomization station 50 and spray forming station 60 and would include the disposition of a spinning water-cooled wheel to receive the melt 56 and to rapidly solidify and spin it into ribbon, as is known.

Depending on the application to be made of the electroslag refining apparatus, as illustrated in FIG. 1, there is a need to control the rate at which a metal stream such as 56 is removed from the cold finger orifice structure 80. The rate at which such a stream of molten metal may be drained from the cold hearth through the cold finger structure 80 is controlled by the cross-sectional area of the orifice and by the hydrostatic head of liquid above the orifice. This hydrostatic head is the result of the column of liquid metal and of the liquid slag which extends above the orifice of the cold finger structure 80. The flow rate of liquid from the cold finger orifice or nozzle has been determined experimentally for a cylindrical orifice.

It is apparent from the experiment that, if an electroslag refining apparatus, such as illustrated in FIG. 2, is operated with a given hydrostatic head, a nozzle area can be selected and provided which permits an essentially constant rate of flow of liquid metal from the refining vessel as long as the hydrostatic head above the nozzle is maintained essentially constant. It is deemed important to the operation of such an apparatus that an essentially constant hydrostatic head be established and maintained. To provide such constant hydrostatic head, it is important that the melting rate of filler metal correspond to the rate of withdrawal of metal in stream 56 from the refining vessel. This may be achieved by controlling the supply of liquid or loose filler metal and corresponding changes of the refining current through control means within box 12.

The rate at which the filler metal is refined in the apparatus of FIG. 1 is determined by the level of refining power supplied to the vessel from the source such as 74 shown in FIG. 1. Such a current may be adjusted to values between about 1,000 to 20,000 amperes, and preferably between about 2,000 to 12,000 amperes. The refining power supplied to, the slag maintains and controls the heating and operating temperature of the slag. Thus, the temperature control of the slag is independent of the rate of filler metal being added to the refining vessel.

In the described apparatus and method, generally a steady state is desired in which the rate of metal melted and entering the refining station 30 as a liquid is equal to the rate at which liquid metal is removed as a stream 56 through the cold finger structure. Slight adjustment to increase or decrease the rate of melting of metal are made by adjusting the rate of introduction of the filler material into the slag.

What is claimed is:

1. A method for electroslag refining comprising:

introducing unrefined metal into an electroslag refining vessel containing a molten slag in a top sleeve thereof;

electrically insulating said vessel from a cold hearth positioned beneath said vessel for collecting molten metal from said vessel;

forming a metal skull of solidified refined metal atop said hearth;

conducting electrical current to said vessel for forming a vessel electrode to carry said current in an electrical circuit through said molten slag and metal skull; and using said electrical current conducted by said vessel to heat said molten slag and melt said unrefined metal for refining thereof as said molten metal descends through said slag and collects in said hearth.

2. The method according to claim 1 further comprising rotating or stirring the slag with the metal in the top sleeve of the refining vessel with an electromagnetic force.

3. The method according to claim 2 comprising the step of providing a cold finger bottom pour spout at a bottom of the hearth for permitting the molten metal to pass through the spout as a metal stream.

4. The method of claim 3 where the stream of molten metal passing from the cold finger orifice is atomized into powder.

5. The method of claim 3 where the stream of molten metal passing from the cold finger orifice is cast into rod.

6. The method of claim 3 where the stream of molten metal passing from the cold finger orifice is melt spun into ribbon.

7. The method of claim 3 where the stream of molten metal passing from the cold finger orifice is a filler metal for cladding or surfacing.

8. The method of claim 3 in which the rate at which molten metal is drained from said hearth is about equivalent to the rate at which the metal is melted.

9. A refined article made by the method of claim 2.

10. The method according to claim 1 further comprising the step of providing a cold finger bottom pour spout at a bottom of the hearth for permitting the molten metal to pass through the spout as a metal stream.

11. The method of claim 10 where the stream of molten metal (56) passing from the cold finger orifice (80) is atomized into a preform article (62).

12. The method of claim 10 where the stream of molten metal passing from the cold finger orifice is atomized into powder.

13. The method of claim 10 where the stream of molten metal passing from the cold finger orifice is cast into rod.

14. The method of claim 10 where the stream of molten metal passing from the cold finger orifice is melt spun into ribbon.

15. The method of claim 10 where the stream of molten metal passing from the cold finger orifice is a filler metal for cladding or surfacing.

16. The method of claim 10 in which the rate at which molten metal (46) is drained from said hearth (40) is about equivalent to the rate at which metal is melted.

17. The method according to claim 1 where the electric circuit comprises a power supply, the molten slag, and said refining vessel to cause resistance heating of the slag.

18. The method of claim 17 where the circuit includes the body of molten metal.

19. The method of claim 1 where the unrefined metal is a superalloy of nickel, cobalt or iron.

20. The method of claim 1 where the unrefined metal is a titanium alloy.

21. The method of claim 1 where the slag is a salt containing calcium fluoride.

22. A refined article made by the method of claim 1.

23. The method of claim 1 additionally comprising controlling introducing the unrefined metal to maintain essentially constant hydrostatic head of said molten metal within the vessel.

24. The method of claim 1 additionally comprising adjusting refining power to control passing the electrical current to maintain a constant temperature control.

25. The method of claim 1 further comprising passing the electrical current through electrically insulated leads to cause current to flow through a skull to heat the skull but not a wall of the hearth.

26. A method for electroslag refining comprising:

introducing unrefined material into an electroslag refining vessel containing a molten slag;

electrically insulating said vessel from a cold hearth positioned therebelow to define a vessel electrode;

conducting electrical current in a circuit through said vessel, slag, and hearth to heat said slag;

melting said unrefined material in said molten slag to form molten metal; and collecting said molten metal in said hearth after descending through and refining by said slag.

27. A method according to claim 1 further comprising:

lowering said unrefined material into said vessel in contact with said molten slag; and conducting electrical current in another circuit through said lowered unrefined material, slag, and hearth to heat said slag.

28. A method according to claim 27 further comprising protecting said vessel from spark erosion by lining said vessel with an electrically conducting material.

29. A method according to claim 28 wherein said electrical current is conducted through said vessel to create an electromagnetic force for stirring said slag and molten metal therein.

30. A method according to claim 29 further comprising:

electrically insulating said vessel along a vertical slot extending radially therethrough; and conducting said electrical current to said vessel through two electrical leads connected to opposite diametrical sides of said vessel.

31. A method according to claim 30 wherein said electrical current is conducted through said hearth through two electrical leads extending through said hearth on opposite diametrical sides thereof.

32. A method according to claim 30 wherein said unrefined material comprises a consumable compact metal body electrode for conducting said electrical current therethrough.

33. A method according to claim 32 further comprising additionally feeding loose unrefined material into said vessel for refining thereof.

34. A method according to claim 32 further comprising additionally feeding liquid unrefined material into said vessel for refining thereof.

35. A method according to claim 32 further comprising conducting said electrical current through said consumable electrode in reverse from said vessel electrode.

* * * * *